US007777402B2

(12) United States Patent
Torisaki

(10) Patent No.: US 7,777,402 B2
(45) Date of Patent: Aug. 17, 2010

(54) PLASMA DISPLAY PANEL IMPROVING DISCHARGE CHARACTERISTICS IN THE INTERNAL PERIPHERAL AREA THEREOF

(75) Inventor: Yasuhiro Torisaki, Yamanashi (JP)

(73) Assignee: Panasonic Corporation, Kadoma-shi, Osaka (JP)

( * ) Notice: Subject to any disclaimer, the term of this patent is extended or adjusted under 35 U.S.C. 154(b) by 393 days.

(21) Appl. No.: 11/476,013

(22) Filed: Jun. 28, 2006

(65) Prior Publication Data

US 2007/0024172 A1 Feb. 1, 2007

(30) Foreign Application Priority Data

Jul. 29, 2005 (JP) ..... 2005-221516

(51) Int. Cl.

| | |
|---|---|
| ***H01J 17/49*** | (2006.01) |
| ***H01J 1/46*** | (2006.01) |
| ***G09G 3/10*** | (2006.01) |
| ***G09G 3/28*** | (2006.01) |

(52) U.S. Cl. ..... 313/307; 313/306; 313/567; 313/581; 313/582; 313/583; 313/584; 313/585; 315/169.4; 345/60

(58) Field of Classification Search ..... None
See application file for complete search history.

(56) References Cited

U.S. PATENT DOCUMENTS

| | | | | |
|---|---|---|---|---|
| 5,587,624 | A * | 12/1996 | Komaki | 313/584 |
| 5,736,815 | A | 4/1998 | Amemiya | |
| 6,353,292 | B1 * | 3/2002 | Takamori et al. | 315/169.4 |
| 6,456,006 | B1 | 9/2002 | Torisaki | |
| 6,713,960 | B2 * | 3/2004 | Hirose | 313/583 |
| 6,979,951 | B2 * | 12/2005 | Kwon | 313/631 |
| 7,256,550 | B2 * | 8/2007 | Park et al. | 315/169.1 |
| 7,687,998 | B2 * | 3/2010 | Park et al. | 315/169.4 |
| 2003/0090212 | A1 * | 5/2003 | Park et al. | 315/169.1 |
| 2005/0041001 | A1 * | 2/2005 | Sumida et al. | 345/60 |

FOREIGN PATENT DOCUMENTS

| | | |
|---|---|---|
| EP | 1 313 124 A2 | 5/2003 |
| JP | 3443167 | 6/2003 |
| WO | WO 01/50493 A1 | 7/2001 |
| WO | WO 2004/068527 | 8/2004 |

OTHER PUBLICATIONS

European Search Report dated Mar. 17, 2008.

* cited by examiner

*Primary Examiner*—Nimeshkumar D Patel
*Assistant Examiner*—Natalie K Walford
(74) *Attorney, Agent, or Firm*—McGinn IP Law Group PLLC

(57) ABSTRACT

A second transparent electrode of each of the row electrodes in each row electrode pair corresponding each of the discharge cells located in an internal peripheral portion of the panel has an electrode area smaller than the electrode area of a first transparent electrode corresponding each of the discharge cells located in a central portion of the panel. The head portion of the second transparent electrode corresponding to each of the discharge cells located in the internal peripheral portion has a row-direction width greater than the row-direction width of the head portion of the first transparent electrode corresponding to each of the discharge cells located in the central portion.

17 Claims, 7 Drawing Sheets

(PANEL CENTRAL PORTION)

(PANEL INTERNAL PERIPHERAL PORTION)

FIRST EMBODIMENT

SECTION V1-V1

SECTION V2-V2

(PANEL CENTRAL PORTION)

(PANEL INTERNAL PERIPHERAL PORTION)

SECOND EMBODIMENT (PANEL CENTRAL PORTION)

(PANEL INTERNAL PERIPHERAL PORTION)

THIRD EMBODIMENT (PANEL CENTRAL PORTION)

(PANEL INTERNAL PERIPHERAL PORTION)

PLASMA DISPLAY PANEL IMPROVING DISCHARGE CHARACTERISTICS IN THE INTERNAL PERIPHERAL AREA THEREOF

BACKGROUND OF THE INVENTION

1. Field of the Invention

This invention relates to a structure of plasma display panels.

The present application claims priority from Japanese Application No. 2005-221516, the disclosure of which is incorporated herein by reference.

2. Description of the Related Art

FIG. 1 illustrates the structure of a row electrode provided in a conventional PDP (Plasma Display Panel).

In FIG. 1, the row electrodes X, Y which constitute a row electrode pair are each composed of bus electrodes Xa, Ya extending in the row direction, and a plurality of short-rectangular-shaped transparent electrodes Xb1, Xb2, Yb1, Yb2 which are placed at regular intervals along the bus electrodes Xa, Ya and extend out from the bus electrodes Xa, Ya toward their counterparts in the row electrode pair so that the transparent electrodes Xb1, Xb2 and the transparent electrodes Yb1, Yb2 face each other across a discharge gap g.

The paired transparent electrodes Xb1 and Yb1 as illustrated on the left-hand side of FIG. 1 are placed in a central area of the panel surface of the PDP. The paired transparent electrodes Xb2 and Yb2 as illustrated on the right-hand side of FIG. 1 are placed in an internal peripheral area of the panel surface around the central area.

The electrode area of each of the transparent electrodes Xb1, Yb1 which are placed in the central area of the panel surface is larger than that of each of the transparent electrodes Xb2, Yb2 which are placed in the internal peripheral area.

A conventional PDP structured as described above is disclosed in JP Patent 3443167, for example.

In the conventional PDP, because of the smaller electrode area of the transparent electrodes Xb2, Yb2 placed in the internal peripheral area, the luminance in the internal peripheral area of the panel surface in which the visibility is low is reduced, resulting in a reduction in power consumption. However, such a reduced electrode area adversely affects the discharge characteristics in the internal peripheral area of the panel surface.

SUMMARY OF THE INVENTION

It is a technical object of the present invention to solve the problem associated with conventional PDPs as described above.

To attain this object, the present invention provides a PDP that comprises a pair of substrates facing each other across a discharge space, and a plurality of row electrode pairs and a plurality of column electrodes placed between the pair of substrates. The row electrode pairs extend in a row direction and are arranged in the column direction. The column electrodes extend in the column direction and are arranged in the row direction to form unit light emission areas within the discharge space in conjunction with the row electrode pairs. Portions of a pair of row electrodes constituting each of the row electrode pairs, which are placed corresponding to each of the unit light emission areas, face each other across a discharge gap. Each of the portions of the row electrodes corresponding to each of the unit light emission areas that are placed in an internal peripheral portion of a panel surface has an electrode area smaller than an electrode area of each of the portions of the row electrodes corresponding to each of the unit light emission areas that are placed in a central portion of the panel surface. An end, close to the discharge gap, of each of the portions of the row electrodes corresponding to each of the unit light emission areas that are placed in the internal peripheral portion of the panel surface has a width in the row direction greater than a width of an end, close to the discharge gap, of each of the portions of the row electrodes corresponding to each of the unit light emission areas that are placed in the central portion of the panel surface.

In an exemplary embodiment of the present invention, portions of a pair of row electrodes constituting each row electrode pair, which are placed corresponding to each discharge cell, face each other across a discharge gap; and each of the portions of the row electrodes corresponding to each of the discharge cells that are placed in an internal peripheral portion of the panel has an electrode area smaller than that of each of the portions of the row electrodes corresponding to each of the discharge cells that are placed in a central portion of the panel; and an end, close to the discharge gap, of each of the portions of the row electrodes corresponding to each of the discharge cells placed in the internal peripheral portion of the panel has a width in the row direction greater than that of an end, close to the discharge gap, of each of the portions of the row electrodes corresponding to each of the discharge cells placed in the central portion of the panel.

In the PDP according to the exemplary embodiment, the amount of discharge in the sustaining discharge initiated in the discharge cells placed in the central portion of the panel is maintained so as to prevent a reduction in the brightness in the central portion, while the amount of discharge in the sustaining discharge initiated in the discharge cells placed in the internal peripheral portion, in which visibility is low, is reduced. In consequence, it is possible to adjust the brightness distribution for a reduction in brightness in the internal peripheral portion. This adjustment in turn makes a reduction in the electric power consumption of the PDP possible. Also, the sustaining discharge is reliably initiated in the internal peripheral portion in which it is not easy to initiate a discharge, whereby the PDP is capable of maintaining the discharge characteristics approximately equally between the central portion and the internal peripheral portion of the panel.

In the PDP according to the exemplary embodiment, each of the row electrodes constituting each of the row electrode pairs is equipped with a bus electrode extending in the row direction, and a plurality of transparent electrodes each extending out from a portion of the bus electrode corresponding to each discharge cells toward the counterpart row electrode in the row electrode pair in the column direction to face a corresponding row-electrode projection of the counterpart row electrode across the discharge gap. Each of the transparent electrodes has a head portion with a large row-direction width placed close to the discharge gap, and a foot portion with a narrow row-direction width connecting the head portion with the bus electrode. The row-direction width of the head portion of the transparent electrode corresponding to each of the discharge cells located in the central portion of the panel is smaller than the row direction width of the head portion of the transparent electrode corresponding to each of the discharge cells located in the internal peripheral portion of the panel. In this case, the sustaining discharge is more reliably initiated in the internal peripheral portion of the panel in which it is not easy to initiate a discharge.

In addition, in the foregoing PDP, the ratio of the area of the head portion of the transparent electrode to the electrode area of the transparent electrode corresponding to each of the discharge cells placed in the central portion of the panel is smaller than the ratio of the area of the head portion of the transparent electrode to the electrode area of the transparent electrode corresponding to each of the discharge cells placed in the internal peripheral portion. In this case, the reset discharge, which determines a black luminance, is initiated at the leading end of the transparent electrode, resulting in suppression of a rise in black luminance in the central portion.

Further, in the foregoing PDP, a phosphor layer of red, green or blue color is formed in each of the discharge cells. The electrode area of each of the transparent electrodes respectively corresponding to the discharge cells of at least one type selected from the three types of the red discharge cell with the red phosphor layer formed therein, the green discharge cell with the green phosphor layer formed therein and the blue discharge cell with the blue phosphor layer formed therein is smaller than the electrode area of the transparent electrode corresponding to each of the discharge cells in which no selection is made between red, green and blue colors. In this case, it is possible to adjust the white balance using the structure of the transparent electrodes.

These and other objects and features of the present invention will become more apparent from the following detailed description with reference to the accompanying drawings.

DETAILED DESCRIPTION OF THE PREFERRED EMBODIMENTS

First Embodiment

Figure 1:
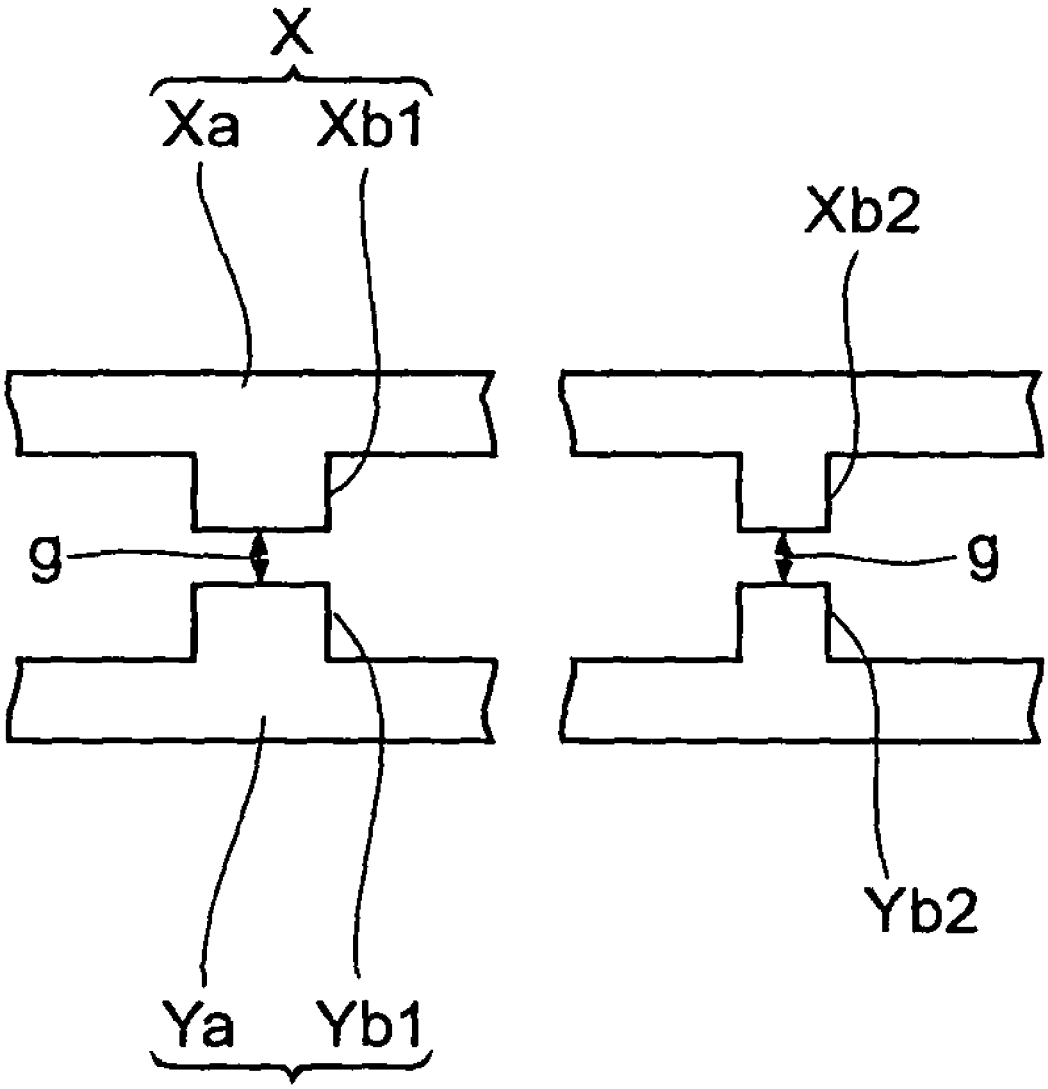
FIG. 1 RELATED ART
FIG. 1 is a diagram illustrating an example of conventional PDPs.
Figure 2:
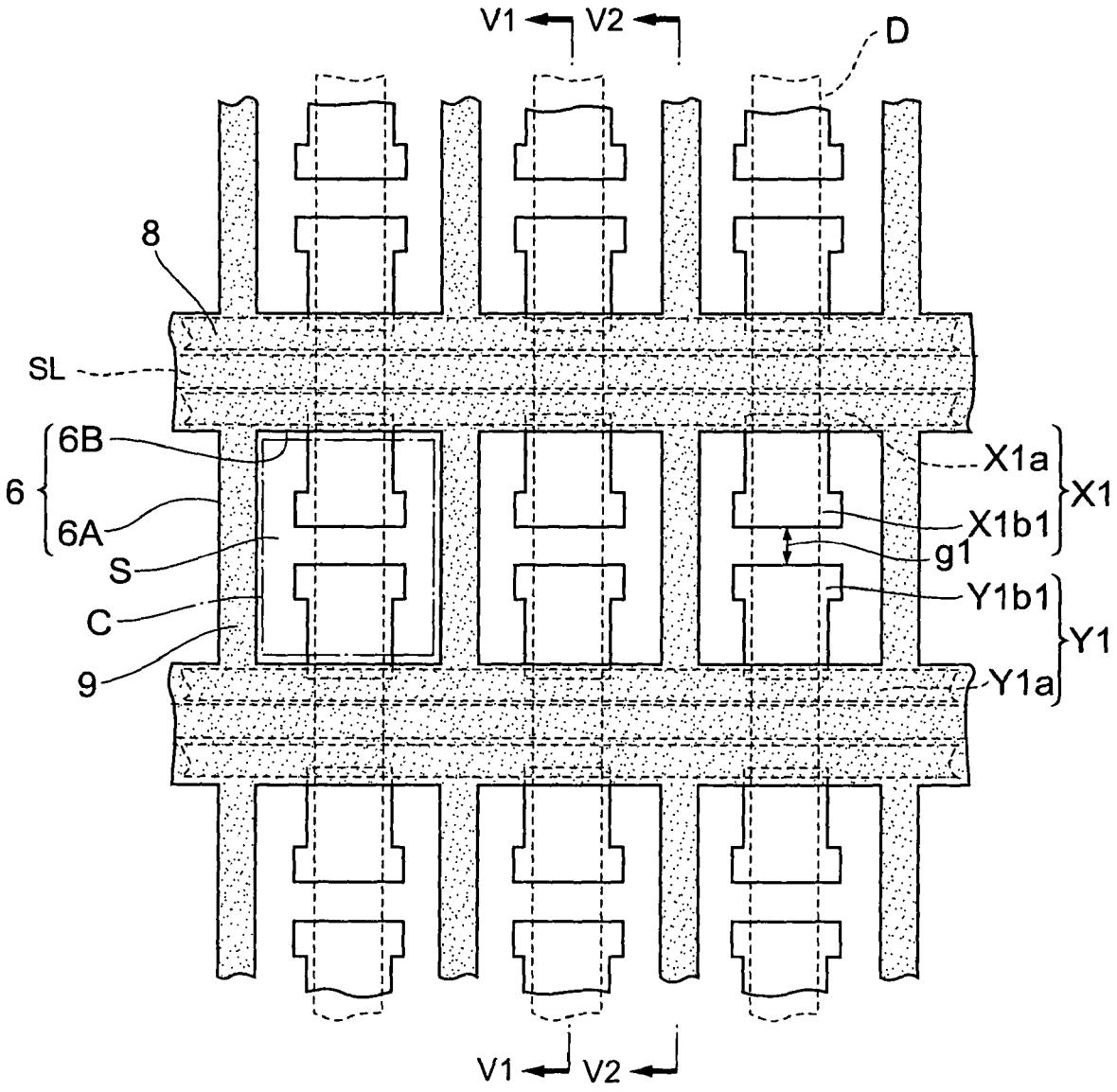
FIG. 2 is a front view illustrating a first embodiment according to the present invention.
Figure 3:
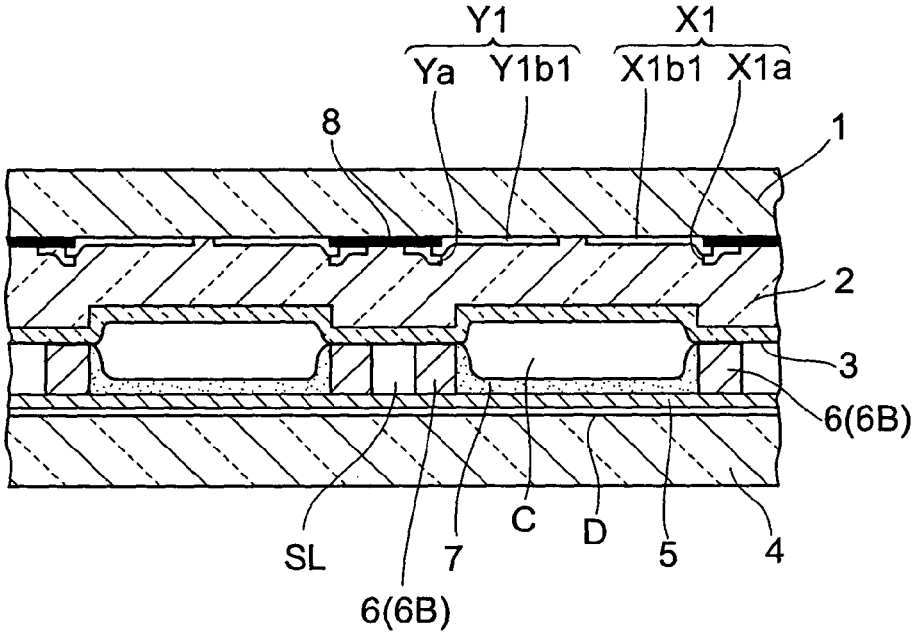
FIG. 3 is a sectional view taken along the V1-V1 line in FIG. 2.
Figure 4:
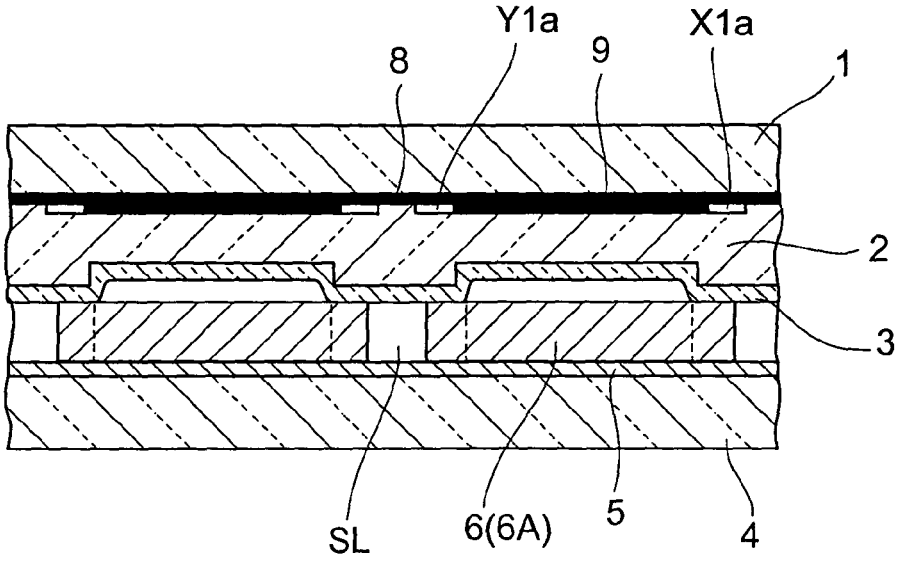
FIG. 4 is a sectional view taken along the V2-V2 line in FIG. 2.

FIGS. 2 to 4 illustrate a first embodiment of a PDP according to the present invention. FIG. 2 is a front view illustrating a central portion of the PDP of the first embodiment. FIG. 3 is a sectional view taken along the V1-V1 line in FIG. 2. FIG. 4 is a sectional view taken along the V2-V2 line in FIG. 2.

In the PDP of the first embodiment illustrated in FIGS. 2 to 4, a plurality of row electrodes (X1, Y1) extends on the rear-facing face (the face facing toward the rear of the PDP) of the front glass substrate 1 serving as the display surface in the row direction of the front glass substrate 1 (the right-left direction in FIG. 2). The row electrodes (X1, Y1) are arranged at regular intervals in the column direction (the vertical direction in FIG. 2).

The row electrode X1 constituting part of each row electrode pair (X1, Y1) includes a metallic bus electrode X1*a* extending in a belt shape in the row direction. Approximately T-shaped first transparent electrodes X1*b*1 are connected to the bus electrode X1*a* at regular intervals.

In addition, second transparent electrodes X1*b*2 are connected at regular intervals to a portion of the bus electrode X1*a* which is located in an internal peripheral portion of the PDP; these are not shown in FIG. 2. Each of the second transparent electrodes X1*b*2 has the electrode area smaller than that of the first transparent electrode X1*b*1 as described later in FIG. 6.

Likewise, the row electrode Y1 includes a metallic bus electrode Y1*a* extending in a belt shape in the row direction. Approximately T-shaped first transparent electrodes Y1*b*1 are connected to the bus electrode Y1*a* at regular intervals. The wide head portion of each of the first transparent electrodes Y1*b*1 faces the wide head portion of the corresponding first transparent electrode X1*b*1 of the row electrode X1 paired with the row electrode Y1 across a discharge gap g1.

In addition, second transparent electrodes Y1*b*2 are connected at regular intervals to a portion of the bus electrode Y1*a* which is in an internal peripheral portion of the PDP; these are not shown in FIG. 2. Each of the second transparent electrodes Y1*b*2 has the electrode area smaller than that of the first transparent electrode Y1*b*1 as described later in FIG. 6. The wide head portion of each of the second transparent electrode Y1*b*2 faces the wide head portion of the corresponding second transparent electrode X1*b*2 of the row electrode XI paired with the row electrode Y1 across a discharge gap g2.

A dielectric layer 2 is formed on the rear-facing face of the front glass substrate 1 so as to overlie the row electrode pairs (X1, Y1).

The rear-facing face of the dielectric layer 2 is in turn overlain with a protective layer 3 formed of high y materials such as MgO.

The front glass substrate 1 is placed parallel to the back glass substrate 4. A plurality of column electrodes D is provided on the inner face (the face facing the rear-facing face of the front glass substrate 1) of the back glass substrate 4. Each of the column electrodes D extends in the column direction along positions each corresponding to the paired first transparent electrodes X1*b*1 and Y1*b*1 of the row electrode pair (X1, Y1) which face each other across the discharge gap g1, or to the paired second transparent electrodes X1*b*2 and Y1*b*2 of the row electrode pair (X1, Y1) which face each other across the discharge gap g2.

A column-electrode protective layer 5 is formed on the inner face of the back glass substrate 4 so as to overlie the column electrodes D.

In turn, approximately ladder-shaped partition wall units 6 are formed on the column-electrode protective layer 5 in positions corresponding to the respective row electrode pairs (X1, Y1). Each of the partition wall units 6 has a plurality of vertical walls 6A and two transverse walls 6B. Each of the vertical walls 6A extends in a belt shape in the column direction in parallel to a mid-area between the adjacent column electrodes D. The two face-to-face transverse walls 6B extend in a belt shape in the row direction in parallel to the respective bus electrodes X1*a*, Y1*a*. The two ends of each of the vertical walls 6A are connected to the respective transverse walls 6B.

A slit SL is formed between the back-to-back transverse walls 6B of the adjacent partition wall units 6 arranged in the column direction.

The partition wall units 6 partition the discharge space S defined between the front glass substrate 1 and the back glass substrate 4 into areas corresponding to the paired first transparent electrodes X1*b*1 and Y1*b*1 of the row electrode pairs (X1, Y1) facing each other across the discharge gap g1 in each row electrode pair (X1, Y1), and to the paired second transparent electrodes X1*b*2 and Y1*b*2 of the row electrode pairs (X1, Y1) facing each other across the discharge gap g2. Thus, quadrangular discharge cells C are formed in the respective areas.

Phosphor layers 7 to which red, green and blue colors are applied, one to each of the discharge cells C, are formed in the respective discharge cells C.

The discharge space S is filled with a discharge gas that includes xenon.

FIGS. 2 to 4 also show black or dark-colored light absorption layers 8 and 9. Each of the light absorption layers 8 is formed on a portion of the rear-facing face of the front glass substrate 1 corresponding to the back-to-back bus electrodes X1*a* and Y1*a* of the adjacent row electrode pairs (X1, Y1) and the area between the back-to-back bus electrodes X1*a* and Y1*a*. Each of the light absorption layers 9 is formed on a portion of the rear-facing face of the front glass substrate 1 facing the vertical wall 6A of the partition wall unit 6.

Figure 5:
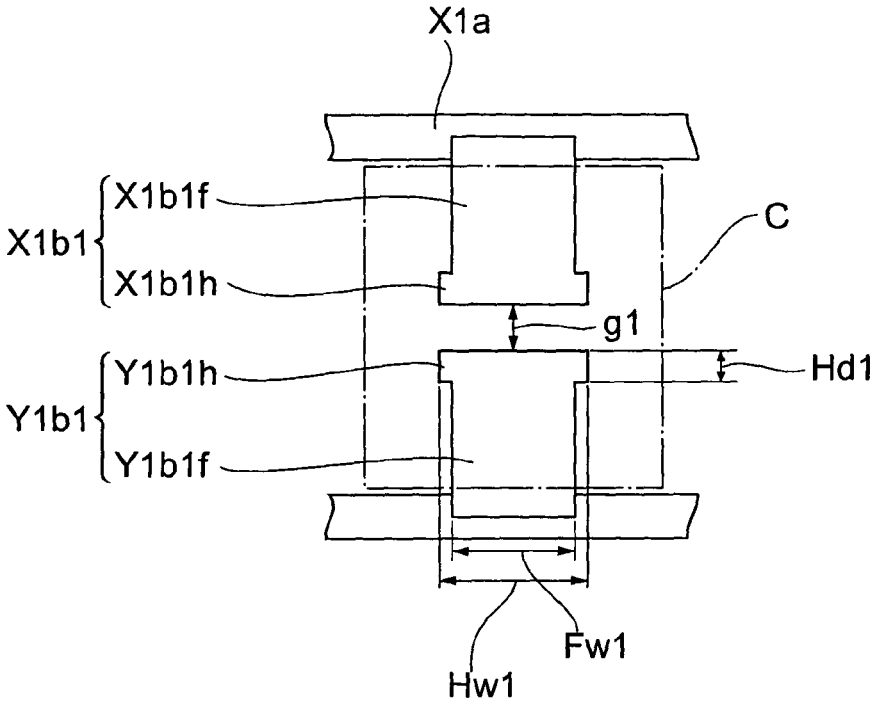
FIG. 5 is a front view illustrating a transparent electrode placed in a central portion of the panel in the first embodiment.
Figure 6:
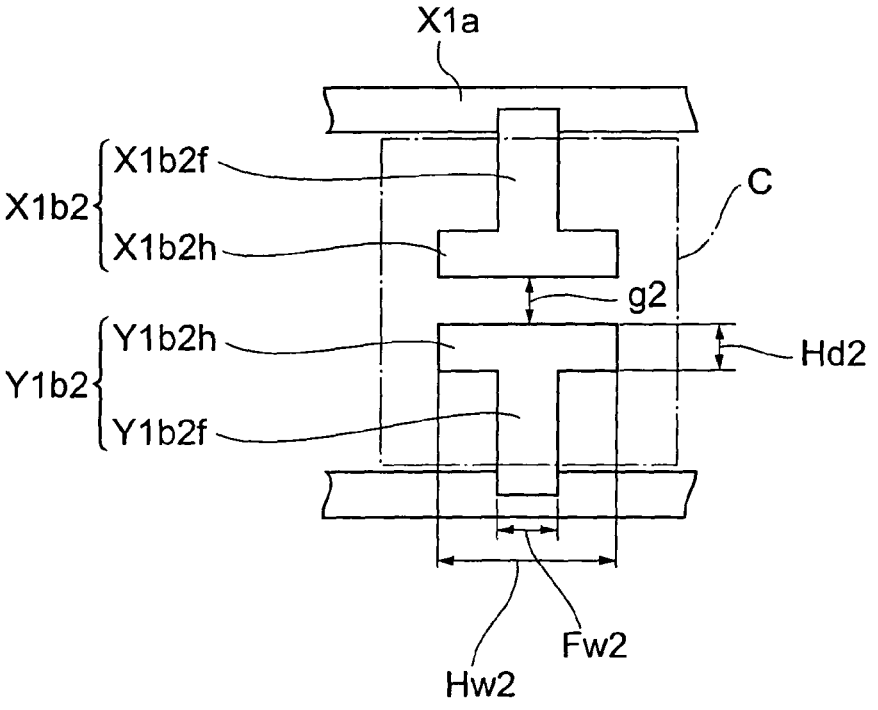
FIG. 6 is a front view illustrating a transparent electrode placed in an internal peripheral portion of the panel in the first embodiment.

FIG. 5 illustrates the first transparent electrodes X1*b*1, Y1*b*1 which are placed in the central portion of the panel of the PDP. FIG. 6 illustrates the second transparent electrodes X1*b*2, Y1*b*2 which are placed in the internal peripheral portion of the panel.

In FIG. 5, the first transparent electrodes X1*b*1, Y1*b*1 are each formed in an approximate T shape made up of the head portions X1*b*1*h*, Y1*b*1*h* which are wide in the row direction and face each other across the discharge gap g1, and the foot portions X1*b*1*f*, Y1*b*1*f* which are narrow in the row direction and connect the head portions X1*b*1*h*, Y1*b*1*h* to the bus electrodes X1*a*, Y1*a*.

FIG. 5 also shows three widths: a width Hd1 of each of the head portions X1*b*1*h*, Y1*b*1*h* of the first transparent electrode X1*b*1, Y1*b*1 in the column direction; a width Hw1 of each of the head portions X1*b*1*h*, Y1*b*1*h* in the row direction; and a width Fw1 of each of the foot portions X1*b*1*f*, Y1*b*1*f* in the row direction. The values of the widths are set at Hw1>Fw1.

In FIG. 6, the second transparent electrodes X1*b*2, Y1*b*2 are each formed in an approximate T shape made up of the head portions X1*b*2*h*, Y1*b*2*h* which are wide in the row direction and face each other across the discharge gap g2, and the foot portions X1*b*2*f*, Y1*b*2*f* which are narrow in the row direction and connect the head portions X1*b*2*h*, Y1*b*2*h* to the bus electrodes X1*a*, Y1*a*.

FIG. 6 also shows three widths: a width Hd2 of each of the head portions X1*b*2*h*, Y1*b*2*h* of the second transparent electrode X1*b*2, Y1*b*2 in the column direction; a width Hw2 of each of the head portions X1*b*2*h*, Y1*b*2*h* in the row direction; and a width Fw2 of each of the foot portions X1*b*2*f*, Y1*b*2*f* in the row direction. The values of the widths are set at Hw2>Fw2.

Regarding the first transparent electrodes X1*b*1, Y1*b*1 and the second transparent electrodes X1*b*2, Y1*b*2, the column-direction width Hd1 and the row-direction width Hw1 of the head portions X1*b*1*h*, Y1*b*1*h* of the first transparent electrodes X1*b*1, Y1*b*1 are set to be respectively smaller than the column-direction width Hd2 and the row-direction width Hw2 of the head portions X1*b*2*h*, Y1*b*2*h* of the second transparent electrodes X1*b*2, Y1*b*2 (Hd1<Hd2, Hw1<Hw2). The row-direction width Fw1 of the foot portion X1*b*1*f*, Y1*b*1*f* of the first transparent electrodes X1*b*1, Y1*b*1 are set to be larger than the row-direction width Fw2 of the foot portions X1*b*2*f*, Y1*b*2*f* (Fw1>FW2).

The second transparent electrodes X1*b*2, Y1*b*2 have larger widths given to the head portion in the row direction and the column direction, but the first transparent electrodes X1*b*1, Y1*b*1 has a larger width given to the foot portion in the row direction. In consequence, the electrode area A1 of each of the first transparent electrodes X1*b*1, Y1*b*1 is greater than the electrode area A2 of each of the second electrodes X1*b*2, Y1*b*2 (A1>A2).

In the foregoing PDP, an address discharge is selectively initiated between the column electrode D and the first transparent electrode Y1*b*1 and/or second transparent electrode Y1*b*2. Then, in each of the discharge cells C in which the address discharge has been produced, a sustaining discharge is initiated between the first transparent electrodes X1*b*1 and Y1*b*1 or between the second transparent electrodes X1*b*2 and Y1*b*2. As a result, vacuum ultraviolet light, which is generated from the xenon included in the discharge gas filling the discharge space S, allows the red, green or blue phosphor layer 7 to emit visible light for the generation of a matrix-display image.

The foregoing PDP is designed such that the electrode area A1 of each of the first transparent electrodes X1*b*1, Y1*b*1 which are located in the central portion of the panel is greater than the electrode area A2 of each of the second transparent electrodes X1*b*2, Y1*b*2 which are located in the internal peripheral portion of the panel. Because of this, the amount of discharge in the sustaining discharge initiated in the discharge cells C placed in the central portion of the panel is maintained so as to prevent a reduction in the brightness in the central portion, whereas the amount of discharge in the sustaining discharge initiated in the discharge cells C placed in the internal peripheral portion of the panel, in which the visibility is low, is reduced, thereby enabling the adjustment of brightness distribution for a reduction in the brightness in the internal peripheral portion, and in turn a reduction in the electric power consumption of the PDP.

At the same time, the column-direction width Hd1 of the head portions X1*b*1*h*, Y1*b*1*h* of the first transparent electrodes X1*b*1, Y1*b*1 is set smaller than the column-direction width Hd2 of the head portions X1*b*2*h*, Y1*b*2*h* of the second transparent electrodes X1*b*2, Y1*b*2 (Hd1<Hd2). Because of this, the sustain discharge is initiated reliably in the internal peripheral portion of the panel where the discharge initiation is difficult. As a result, the discharge characteristics of the PDP are able to be maintained approximately concurrently between the central portion and the internal peripheral portion of the panel.

In addition, in the PDP, the ratio of the area of each of the head portions X1*b*1*h*, Y1*b*1*h* of the first transparent electrodes X1*b*1, Y1*b*1 placed in the central portion to the electrode area A1 is smaller than the ratio of the area of each of the head portions X1*b*2*h*, Y1*b*2*h* of the second transparent electrodes X1*b*2, Y1*b*2 placed in the internal peripheral portion to the electrode area A2. In consequence, a rise in black luminance in the central portion can be suppressed.

This is because the reset discharge that determines the black luminance is initiated at the leading end of the transparent electrode.

Figure 7:
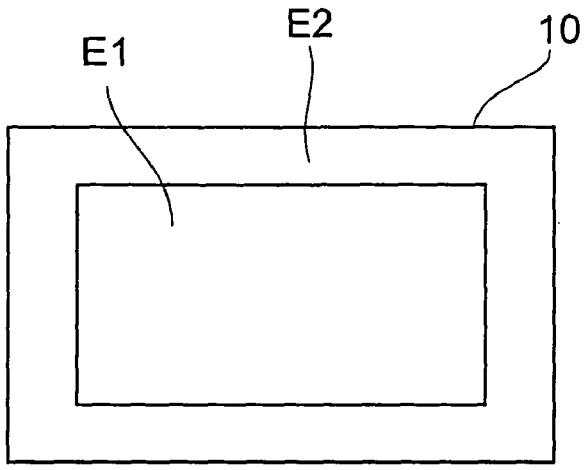
FIG. 7 is a diagram illustrating one area division of the panel in the first embodiment.

Regarding the position of the first transparent electrodes X1*b*1, Y1*b*1 and the second transparent electrodes X1*b*2, Y1*b*2, for example, the first transparent electrodes X1*b*1, Y1*b*1 are placed in a central area El in the panel 10 as illustrated in FIG. 7, and the second transparent electrodes X1*b*2, Y1*b*2 are placed in an internal peripheral area E2.

Figure 8:
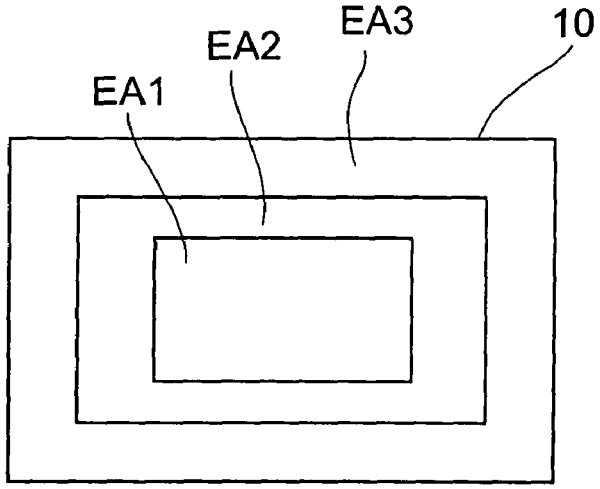
FIG. 8 is a diagram illustrating another area division of the panel in the first embodiment.

The foregoing describes the case of two types of the transparent electrode of the row electrode as an example, but the first embodiment is not limited to this case. For example, as illustrated in FIG. 8, the panel 10 may be divided into three areas: a central area EA1, a middle area EA2 and an internal peripheral area EA3 arranged in order from the central portion toward the periphery, and the sizes of the transparent electrodes placed in the three areas may be reduced in order from the central area EA1.

As another possible case, the panel 10 may be divided into four or more areas arranged in order from the central portion toward the periphery, and the sizes of the transparent electrodes placed in the respective areas may be reduced in order from the central area.

Second Embodiment

Figure 9:
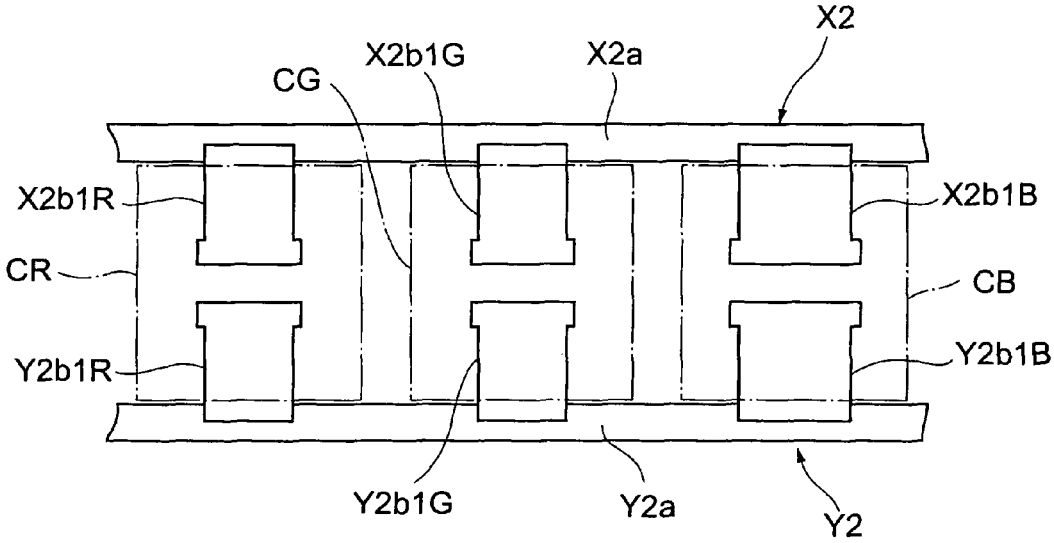
FIG. 9 is a front view illustrating a transparent electrode placed in a central portion of the panel in a second embodiment according to the present invention.
Figure 10:
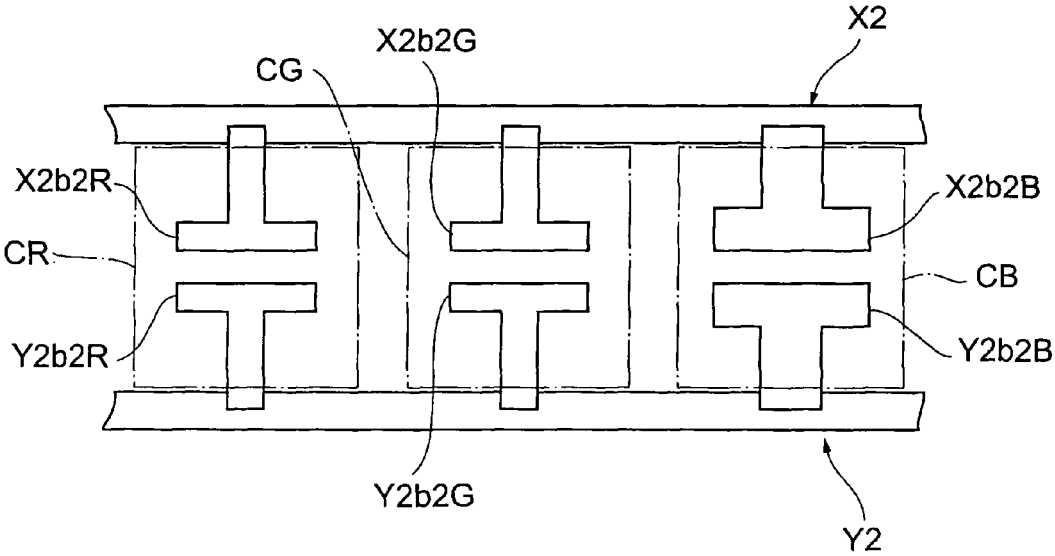
FIG. 10 is a front view illustrating a transparent electrode placed in an internal peripheral portion of the panel in the second embodiment.

FIG. 9 illustrates first transparent electrodes placed in the central area of the panel surface of the PDP in a second embodiment of the present invention, and FIG. 10 illustrates second transparent electrodes placed in the internal peripheral area of the panel.

In FIGS. 9 and 10, a pixel is made up of the three discharge cells: a discharge cell CR with a red phosphor layer formed therein, a discharge cell CG with a green phosphor layer formed therein, and a discharge cell CB with a blue phosphor layer formed therein.

In a central portion of the panel as shown in FIG. 9, first transparent electrodes X2*b*1R, Y2*b*1R respectively constituting part of the row electrodes X2, Y2 are placed corresponding to the red discharge cell CR; first transparent electrodes X2*b*1G, Y2*b*1G are placed corresponding to the green discharge cell CG; and first transparent electrodes X2*b*1B, Y2*b*1B are placed corresponding to the blue discharge cell CB.

In an internal peripheral portion of the panel as shown in FIG. 10, second transparent electrodes X2*b*2R, Y2*b*2R respectively constituting part of the row electrodes X2, Y2 are placed corresponding to the red discharge cell CR; second transparent electrodes X2*b*2G, Y2*b*2G are placed corresponding to the green discharge cell CG; and second transparent electrodes X2*b*2B, Y2*b*2B are placed corresponding to the blue discharge cell CB.

The relationships of the shape and the size of the parts between the first transparent electrodes X2*b*1R, X2*b*1G, X2*b*1B, Y2*b*1R, Y2*b*1G, Y2*b*1B and the second transparent electrodes X2*b*2R, X2*b*2G, X2*b*2B, Y2*b*2R, Y2*b*2G, Y2*b*2B are as in the case of the first embodiment.

The first transparent electrodes X2*b*1R, X2*b*1G, X2*b*1B, Y2*b*1R, Y2*b*1G, Y2*b*1B are greater in the electrode area, and the second transparent electrodes X2*b*2R, X2*b*2G, X2*b*2B, Y2*b*2R, Y2*b*2G, Y2*b*2B are greater in the row-direction width of the head portions facing each other across the discharge gap.

As illustrated in FIG. 9, all the first transparent electrodes X2*b*1R, X2*b*1G, X2*b*1B, Y2*b*1R, Y2*b*1G, Y2*b*1B, which are placed in the central portion of the panel, are formed to have the same electrode area. In contrast, as illustrated in FIG. 10, the second transparent electrodes placed in the internal peripheral portion of the panel are formed such that the electrode area A2R of the second transparent electrodes X2*b*2R, Y2*b*2R corresponding to the red discharge cell CR is smaller than the electrode area A2G of the second transparent electrodes X2*b*2G, Y2*b*2G corresponding to the green discharge cell CG and the electrode area A2B of the second transparent electrodes X2*b*2B, Y2*b*2B corresponding to the blue discharge cell CB (A2R<A2G, A2B).

Thus, between the central portion and the internal peripheral portion of the panel, the rate of reduction in the electrode area in the red discharge cell CR is higher than those in the green discharge cell CG and the blue discharge cell CB. The central portion of the panel is smaller than the internal peripheral portion in the ratio (A2G/A2R) of the electrode area A2G of the second electrodes X2*b*2G, Y2*b*2G to the electrode area A2R of the second transparent electrodes X2*b*2R, Y2*b*2R, and the ratio (A2B/A2R) of the electrode area A2B of the second transparent electrodes X2*b*2B, Y2*b*2B to the electrode area A2R.

When the electrode area of each transparent electrode is set as in the foregoing PDP, it is possible to adjust the white balance in a panel having the characteristics in which the white color of the image displayed on the internal peripheral portion of the panel is tinged with red.

In a panel having the characteristics in which the white color of the image displayed on the internal peripheral portion is tinged with green, the rate of reduction in the electrode area in the internal peripheral portion can be set to be greater in the green discharge cell CG than in the other discharge cells CR, CB. In a panel having the characteristics in which a white color of the image displayed on the internal peripheral portion is tinged with blue, the rate of reduction in the electrode area in the internal peripheral portion can be set to be greater in the blue discharge cell CB than in the other discharge cells CR, CG.

Third Embodiment

Figure 11:
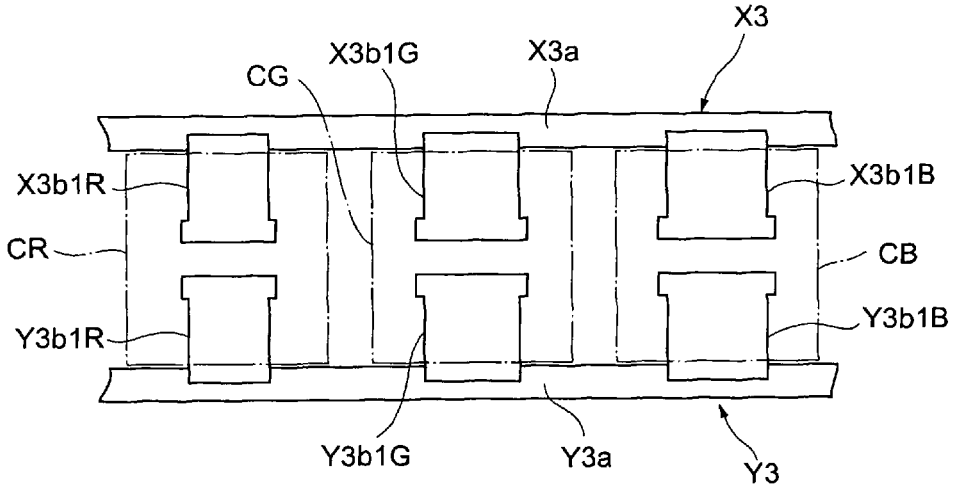
FIG. 11 is a front view illustrating a transparent electrode placed in a central portion of the panel in a third embodiment according to the present invention.
Figure 12:
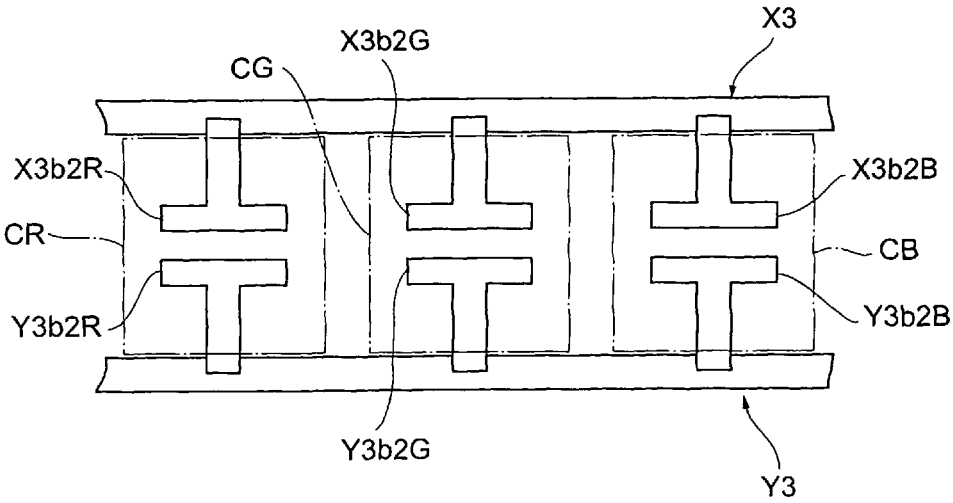
FIG. 12 is a front view illustrating a transparent electrode placed in an internal peripheral portion of the panel in the third embodiment.

FIG. 11 illustrates first transparent electrodes placed in the central area of the panel surface of the PDP in a third embodiment of the present invention, and FIG. 12 illustrates second transparent electrodes placed in the internal peripheral area of the panel.

In FIGS. 11 and 12, a pixel is made up of the three discharge cells: a discharge cell CR with a red phosphor layer formed therein, a discharge cell CG with a green phosphor layer formed therein, and a discharge cell CB with a blue phosphor layer formed therein.

In a central portion of the panel as shown in FIG. 11, first transparent electrodes X3*b*1R, Y3*b*1R respectively constituting part of the row electrodes X3, Y3 are placed corresponding to the red discharge cell CR; first transparent electrodes X3*b*1G, Y3*b*1G are placed corresponding to the green discharge cell CG; and first transparent electrodes X3*b*1B, Y3*b*1B are placed corresponding to the blue discharge cell CB.

In an internal peripheral portion as shown in FIG. 12, second transparent electrodes X3*b*2R, Y3*b*2R respectively constituting part of the row electrodes X3, Y3 are placed corresponding to the red discharge cell CR; second transparent electrodes X3*b*2G, Y3*b*2G are placed corresponding to the green discharge cell CG; and second transparent electrodes X3*b*2B, Y3*b*2B are placed corresponding to the blue discharge cell CB.

The relationships of the shape and the size of the parts between the first transparent electrodes X3*b*1R, X3*b*1G, X3*b*1B, Y3*b*1R, Y3*b*1G, Y3*b*1B and the second transparent electrodes X3*b*2R, X3*b*2G, X3*b*2B, Y3*b*2R, Y3*b*2G, Y3*b*2B are as in the case of the first embodiment.

The first transparent electrodes X3*b*1R, X3*b*1G, X3*b*1B, Y3*b*1R, Y3*b*1G, Y3*b*1B are greater in the electrode area, and the second transparent electrodes X3*b*2R, X3*b*2G, X3*b*2B, Y3*b*2R, Y3*b*2G, Y3*b*2B are greater in the row-direction width of the head portions facing each other across the discharge gap.

As illustrated in FIG. 12, all the second transparent electrodes X3*b*2R, X3*b*2G, X3*b*2B, Y3*b*2R, Y3*b*2G, Y3*b*2B, which are placed in the internal peripheral portion, are formed to have the same electrode area. In contrast, as illustrated in FIG. 11, the first transparent electrodes placed in the central portion are formed such that the electrode area A1R of the first transparent electrodes X3*b*1R, Y3*b*1R corresponding to the red discharge cell CR is smaller than the electrode area A1G of the first transparent electrodes X3*b*1G, Y3*b*1G corresponding to the green discharge cell CG and the electrode area A1B of the first transparent electrodes X3*b*1B, Y3*b*1B corresponding to the blue discharge cell CB (A1R<A1G, A1B).

Thus, between the central portion and the internal peripheral portion of the panel, the rate of reduction in the electrode area in the red discharge cell CR is lower than in the green discharge cell CG and the blue discharge cell CB.

When the electrode area of each transparent electrode is set as in the foregoing PDP, it is possible to adjust the white balance in a panel having the characteristics in which the white color of the image displayed on the central portion of the panel is tinged with red.

In a panel having the characteristics in which the white color of the image displayed on the central portion is tinged with green, the electrode area A1G of the first transparent electrodes X3*b*1G, Y3*b*1G facing the green discharge cell CG in the central portion can be set to be smaller than those of the first transparent electrodes facing the discharge cells CR, CB. In a panel having the characteristics in which the white color of the image displayed on the central portion is tinged with blue, the electrode area A1B of the first transparent electrodes X3*b*1B, Y3*b*1B facing the blue discharge cell CB in the central portion can be set to be smaller than those of the first transparent electrodes in the other discharge cells CR, CG.

A fundamental idea of the PDPs in the foregoing embodiments is that portions of a pair of row electrodes constituting a row electrode pair, which are placed corresponding to each discharge cell, face each other across a discharge gap; each of the portions of the row electrodes corresponding to each of the discharge cells that are placed in an internal peripheral portion of the panel has an electrode area smaller than that of each of the portions of the row electrodes corresponding to each of the discharge cells that are placed in a central portion of the panel; and an end, close to the discharge gap, of each of the portions of the row electrodes corresponding to each of the discharge cells that are placed in the internal peripheral portion of the panel has a width in the row direction greater than that of an end, close to the discharge gap, of each of the portions of the row electrodes corresponding to each of the discharge cells that are placed in the central portion of the panel.

In a PDP based on this fundamental idea, the amount of discharge in the sustaining discharge initiated in the discharge cells placed in the central portion is maintained so as to prevent a reduction in the brightness in the central portion, while the amount of discharge in the sustaining discharge initiated in the discharge cells placed in the internal peripheral portion, in which visibility is low, is reduced. In consequence, it is possible to adjust the brightness distribution for a reduction in brightness in the internal peripheral portion. This adjustment in turn makes a reduction in the electric power consumption of the PDP possible. Also, the sustaining discharge is reliably initiated in the internal peripheral portion in which it is not easy to initiate a discharge, whereby the PDP is capable of maintaining the discharge characteristics approximately equally between the central portion and the internal peripheral portion of the panel.

The terms and description used herein are set forth by way of illustration only and are not meant as limitations. Those skilled in the art will recognize that numerous variations are possible within the spirit and scope of the invention as defined in the following claims.

What is claimed is:

1. A plasma display panel comprising a pair of substrates facing each other across a discharge space, and a plurality of row electrode pairs and a plurality of column electrodes placed between the pair of substrates, the row electrode pairs extending in a row direction and being arranged in a column direction, the column electrodes extending in the column direction and being arranged in the row direction to form unit light emission areas within the discharge space in conjunction with the row electrode pairs, wherein:

portions of a pair of row electrodes constituting each of the row electrode pairs, which are placed corresponding to each of the unit light emission areas, face each other across a discharge gap;

each of the portions of the row electrodes corresponding to each of the unit light emission areas that are placed in an internal peripheral portion of a panel surface has an electrode area smaller than an electrode area of each of the portions of the row electrodes corresponding to each of the unit light emission areas that are placed in a central portion of the panel surface; and an end, close to the discharge gap, of the row electrodes in the internal peripheral portion has a width greater than a width of an end, close to the discharge gap, of the row electrodes in the central portion.

2. A plasma display panel according to claim 1, wherein:

each of the row electrodes constituting each of the row electrode pairs is equipped with a row-electrode body extending in the row direction, and a plurality of row-electrode projections each extending out from a portion of the row-electrode body which corresponds to each of the unit light emission areas toward the counterpart row electrode in the row electrode pair in the column electrode to face a corresponding row-electrode projection of the counterpart row electrode across the discharge gap;

each of the row-electrode projections has a leading portion with a large width in the row direction placed close to the discharge gap, and a joint portion with a narrow width in the row direction connecting the leading portion with the row-electrode body; and the width, in the row direction, of the leading portion of the row-electrode projection corresponding to each of the unit light emission areas located in the central portion of the panel surface is smaller than the width, in the row direction, of the leading portion of the row-electrode projection corresponding to each of the unit light emission areas located in the internal peripheral portion of the panel surface.

3. A plasma display panel according to claim 2, wherein an area of the leading portion of the row-electrode projection corresponding to each of the unit light emission areas located in the central portion of the panel surface is smaller than an area of the leading portion of the row-electrode projection corresponding to each of the unit light emission areas located in the internal peripheral portion of the panel surface, and an area of the joint portion of the row-electrode projection corresponding to each of the unit light emission areas located in the central portion of the panel surface is greater than an area of the joint portion of the row-electrode projection corresponding to each of the unit light emission areas located in the internal peripheral portion of the panel surface.

4. A plasma display panel according to claim 2, wherein the leading portion of the row-electrode projection corresponding to each of the unit light emission areas located in the central portion of the panel surface has both the width in the row direction and a width in the column direction smaller than the width in the row direction and a width in the column direction of the leading portion of the row-electrode projection corresponding to each of the unit light emission areas located in the internal peripheral portion of the panel surface.

5. A plasma display panel according to claim 2, wherein a ratio of an area of the leading portion of the row electrode projection to an electrode area of the row-electrode projection corresponding to each of the unit light emission areas located in the central portion of the panel surface is smaller than a ratio of an area of the leading portion of the row electrode projection to an electrode area of the row-electrode projection corresponding to each of the unit light emission areas located in the internal peripheral portion of the panel surface.

6. A plasma display panel according to claim 2, wherein the panel surface is divided into a central portion and either one internal peripheral portion or two or more internal peripheral portions surrounding the central portion, and the farther each of the internal peripheral portions is from the central portion, the smaller the electrode area of the row-electrode projection corresponding to each of the unit light emission areas, and the greater the width of the leading portion in the row direction.

7. A plasma display panel according to claim 2, further comprising a phosphor layer of either red, green or blue colors formed in each of the unit light emission areas, wherein an electrode area of the row-electrode projection corresponding to at least one unit light emission area selected from the red unit light emission area with the red phosphor layer formed therein, the green unit light emission area with the green phosphor layer formed therein and the blue unit light emission area with the blue phosphor layer formed therein is smaller than an electrode area of the row-electrode projection corresponding to each of the unit light emission areas in which no selection is made between red, green and blue colors.

8. A plasma display panel according to claim 7, wherein a ratio of the larger electrode area of the row-electrode projection to the smaller electrode area of the row-electrode projection is larger in the row-electrode projections corresponding to the unit light emission areas placed in the internal peripheral portion of the panel surface than in the row-electrode projections corresponding to the unit light emission areas placed in the central portion of the panel surface.

9. A plasma display panel according to claim 7, wherein a ratio of the larger electrode area of the row-electrode projection to the smaller electrode area of the row-electrode projection is larger in the row-electrode projections corresponding to the unit light emission areas placed in the central portion of the panel surface than in the row-electrode projections corresponding to the unit light emission areas placed in the internal peripheral portion of the panel surface.

10. A plasma display panel according to claim 1, wherein the end, close to the discharge gap, of each of the portions of the row electrodes corresponding to each of the unit light emission areas that are placed in the internal peripheral portion of the panel surface has a width in the column direction greater than a width of the end, close to the discharge gap, of each of the portions of the row electrodes corresponding to each of the unit light emission areas that are placed in the central portion of the panel surface.

11. A plasma display panel comprising:

a pair of substrates facing each other across a discharge space; and a plurality of row electrodes placed between the pair of substrates, wherein a width of an end portion, close to the discharge space, of row electrodes in a central portion of the plasma display panel is smaller than a width of an end portion, close the discharge space, of row electrodes in an internal peripheral portion of the plasma display panel.

12. The plasma display panel according to claim 11, wherein the row electrodes comprise substantially T-shaped transparent electrodes, the T-shaped transparent electrodes having a head portion corresponding to the end portion of the row electrodes.

13. The plasma display panel according to claim 12, wherein the head portion of transparent electrodes in the internal peripheral portion of the panel surface has a width in the row direction greater than a width in the row direction of a head portion of transparent electrodes in the central portion of the panel surface.

14. The plasma display panel according to claim 12, wherein the head portion of transparent electrodes in the internal peripheral portion of the panel surface has a width in the column direction greater than a width in the column direction of a head portion of transparent electrodes in the central portion of the panel surface.

15. The plasma display panel according to claim 13, wherein the head portion of transparent electrodes in the internal peripheral portion of the panel surface has a width in the column direction greater than a width in the column direction of a head portion of transparent electrodes in the central portion of the panel surface.

16. The plasma display panel according to claim 12, wherein a ratio of area of the head portion of transparent electrodes in the internal peripheral portion of the panel surface is larger than a ratio of area of the head portion of transparent electrodes in the central portion of the panel surface.

17. A plasma display panel comprising:

a pair of substrates facing each other across a discharge space; and a plurality of row electrode pairs placed between the pair of substrates, wherein portions of a pair of row electrodes constituting each of the row electrode pairs, which are placed corresponding to each of the unit light emission areas, facing each other across a discharge gap, and an end, close to the discharge gap, of the row electrodes in the internal peripheral portion has a width greater than a width of an end, close to the discharge gap, of the row electrodes in the central portion.

* * * * *